US006895905B2

(12) United States Patent
Bontaz et al.

(10) Patent No.: US 6,895,905 B2
(45) Date of Patent: May 24, 2005

(54) MULTIPLE SPRAY ENGINE COOLING NOZZLE AND ENGINES EQUIPPED WITH SUCH NOZZLES

(75) Inventors: Christophe Bontaz, Marignier (FR); Denis Clement, Mieussy (FR)

(73) Assignee: Bontaz Centre, Marnaz (FR)

( * ) Notice: Subject to any disclaimer, the term of this patent is extended or adjusted under 35 U.S.C. 154(b) by 70 days.

(21) Appl. No.: 10/653,534

(22) Filed: Sep. 2, 2003

(65) Prior Publication Data

US 2004/0040520 A1 Mar. 4, 2004

(30) Foreign Application Priority Data

Sep. 2, 2002 (FR) ..... 02 11081
Nov. 15, 2002 (FR) ..... 02 14550

(51) Int. Cl.[7] ..... F01P 1/04
(52) U.S. Cl. ..... 123/41.35
(58) Field of Search ..... 123/41.35

(56) References Cited

U.S. PATENT DOCUMENTS 4,206,726 A 6/1980 Johnson, Jr. et al.
4,408,575 A 10/1983 Clairmont, Jr. et al.
4,715,335 A * 12/1987 Elsbett et al. ..... 123/41.35
4,979,473 A 12/1990 Lee
5,267,534 A 12/1993 Berlinger
5,649,505 A 7/1997 Tussing
5,915,345 A 6/1999 Kling et al.
5,917,418 A * 6/1999 Han ..... 123/41.35
2003/0005893 A1 1/2003 Bontaz

FOREIGN PATENT DOCUMENTS

| | | |
|---|---|---|
| DE | 196 34 742 A1 | 3/1998 |
| EP | 0 423 830 A1 | 4/1991 |
| EP | 1 273 774 A1 | 1/2003 |
| FR | 2 745 329 A1 | 8/1997 |
| JP | 07 317519 A | 5/1995 |
| WO | WO 93/05285 | 3/1993 |

* cited by examiner

*Primary Examiner*—Noah P. Kamen
(74) *Attorney, Agent, or Firm*—RatnerPrestia

(57) ABSTRACT

A nozzle in accordance with the invention includes a nozzle body with a penetrating portion conformed to engage axially in a bore in the engine and to receive a cooling fluid arriving via said bore. An outlet structure includes two outlet tubes, each outlet tube being appropriately curved to create two jets of cooling fluid and to direct them toward respective different cooling areas of an engine piston.

14 Claims, 9 Drawing Sheets

FIG. 15
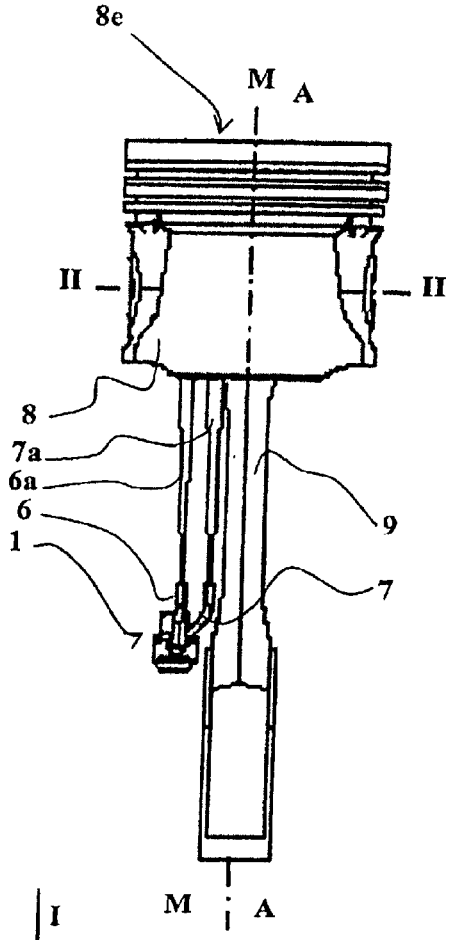
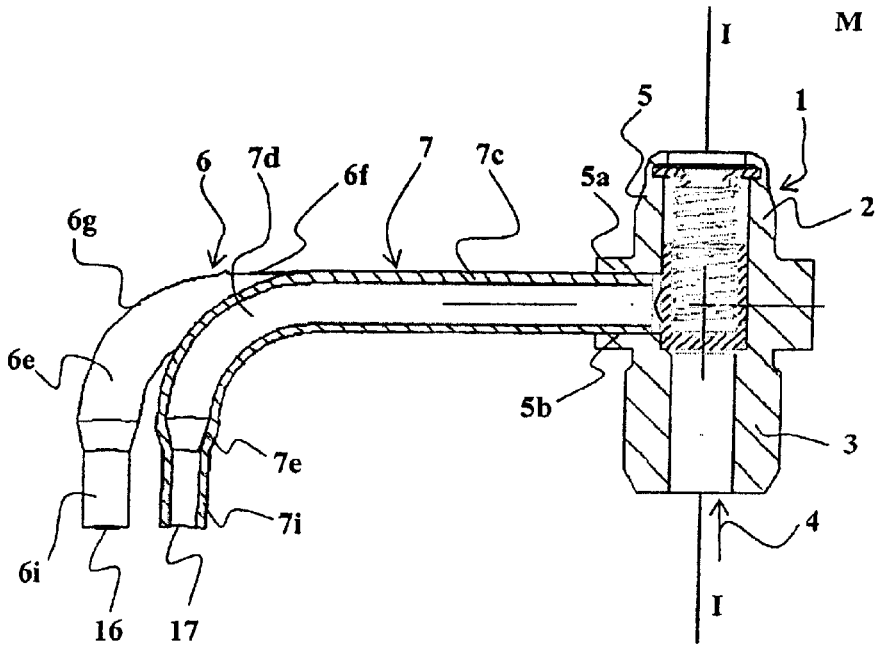
FIG. 16

MULTIPLE SPRAY ENGINE COOLING NOZZLE AND ENGINES EQUIPPED WITH SUCH NOZZLES

TECHNICAL FIELD OF THE INVENTION

The present invention relates to nozzles for cooling the pistons of an internal combustion engine, which are used to spray a cooling fluid such as oil onto an appropriate area of the piston, and to engines equipped with such nozzles.

The piston cooling nozzles usually employed are separate components, fixed to the engine block and communicating with a cooling fluid feed orifice. The position of the nozzle is determined accurately to produce a jet of cooling fluid directed toward a precise area of the piston bottom or toward a piston tunnel inlet.

In internal combustion engines under development at present, each piston of the engine is cooled by associating it with a cooling nozzle that sprays one or more jets of cooling fluid toward a single piston bottom area. For example, the documents FR 2 745 329, U.S. Pat. No. 4,206,726, EP 0 423 830, and JP 07 317519 describe spraying a single jet of cooling fluid toward the piston bottom. The documents DE 196 34742 and U.S. Pat. No. 5,649,505 describe spraying a plurality of parallel jets toward a single piston bottom area. The nozzle is fixed into the engine cylinder either from the outside or from the inside. Thus the documents U.S. Pat. No. 5,649,505 and EP 0 423 830 describe cooling nozzle structures that are inserted into the engine from the outside. These nozzles are inaccurate because of the shortness of the nozzle outlet section, whose length is limited by the size of the passage into which the nozzle is inserted.

The document U.S. Pat. No. 4,206,726 describes a nozzle whose fixing into a passage necessitates simultaneous access to the interior and to the exterior of the engine cylinder.

Documents FR 2 745 329 and JP 07 317519 describe a nozzle including a nozzle body with a penetrating portion conformed to engage axially in a bore in the engine block and to receive cooling fluid arriving via said bore. The nozzle has an outlet structure including a radial fluid passage in the nozzle body and an outlet passage adapted to direct an outlet fluid jet toward the piston bottom area to be cooled.

The flowrate of the jet of cooling fluid sprayed toward the piston bottom is chosen to obtain good cooling. However, the performance of modern internal combustion engines is continuously being improved, and so there is a requirement to increase further the capacity for cooling the portion of the piston that is nearest the gas combustion area. It is apparent that the nozzles currently employed limit the capacity for cooling the piston.

The evolution of engine thermodynamics leads to increasing piston temperatures necessitating nozzles of higher performance. An attempt has been made to improve cooling by providing internal tunnels in the piston to provide cooling as close as possible to the combustion area, which is the highest temperature area of the engine. Pistons with internal tunnels are described in the documents FR 2 745 329 and U.S. Pat. No. 4,206,726, for example. A tunnel is a generally annular cavity in the piston and communicates with the lower space under the piston via at least one inlet. The nozzle sprays the cooling fluid into this inlet. Thus the piston is still relatively thick, to withstand the mechanical stress, and the tunnel conveys the cooling fluid into the area that is closest to the combustion chamber.

The nozzle must produce a very accurate jet, since the tunnel inlet is generally at a distance of approximately 150 millimeters from the nozzle, which is fixed to the engine block, and the diameter of the tunnel inlet is only 5 or 6 millimeters. As much of the cooling fluid as possible must enter this small orifice. Furthermore, the nozzle must have a structure that is easy to fabricate so that it has a low cost suited to mass production in the automobile industry.

Prior art nozzle structures are not satisfactory. For example, document JP 07 317519 describes a complex and costly cast one-piece structure with two parallel passages and a connecting ring. The document FR 2 745 329 describes a similar casting, which has to be machined, including a one-piece passage and a connecting ring.

STATEMENT OF THE INVENTION

The problem addressed by the present invention is that of designing a new cooling nozzle structure that can improve further the capacity for cooling the piston, for a given cooling fluid flowrate, whilst remaining compatible with the very small space available in the engine for the placement of this kind of cooling nozzle.

Another object of the invention is to provide a nozzle of the above kind whose structure is particularly simple so that it is simple and economical to mass produce.

The present invention stems from the observation that there is no doubt that it is very good for the cooling effect to place as much oil as possible in the tunnel inlet of a piston, but that problems can still arise from an uneven distribution of the oil in the piston body.

To achieve the above and other objects, the invention proposes a cooling nozzle for cooling a piston of an internal combustion engine, the nozzle including a nozzle body having a penetrating portion conformed to be engaged axially in a bore in the engine in an axial penetration direction and to receive a cooling fluid arriving via said bore; the nozzle includes an outlet structure having at least one radial fluid passage in the nozzle body and at least one first outlet passage and one second outlet passage adapted to direct toward the piston to be cooled at least two separate jets of cooling fluid; the first outlet passage comprises a first outlet tube attached to the nozzle body and including a first radial connecting section generally perpendicular to the axial penetration direction and connected by an elbow to a first axial spraying section terminating at a first orifice and the second outlet passage comprises a second outlet tube including a second radial connecting section offset angularly away from the first radial connecting section and connected by an elbow to a second axial spraying section terminating at a second orifice.

The two jets of cooling fluid produced by the above nozzle are substantially parallel to each other and at a distance from each associated with the angularly offset radial sections.

In a first embodiment, the outlet tubes are connected to the nozzle body by separate radial passages in which proximal ends of the outlet tubes are force fitted and brazed.

For example, two outlet tubes are connected to the nozzle body by two separate radial passages and by two radial connecting sections substantially perpendicular to each other and perpendicular to the axial penetration direction, the first outlet tube having a connecting section that extends in a direction generally parallel to or convergent with respect to the radial connecting section of the second outlet tube and is angularly connected, firstly, to the first radial connecting section by an elbow and, secondly, to a first axial spraying section by a second elbow, so as to spray cooling fluid toward two areas of the same piston at a relatively great distance from each other and away from all components moving in the engine cylinder.

In a second embodiment, the nozzle includes a first outlet tube connected to the sprayer body by a single radial passage, the first outlet tube including the first orifice and having a larger diameter intermediate section leading into a smaller diameter end section, to which a second outlet tube including the second orifice is connected.

For example, the first outlet tube can have an upstream section and a downstream section linked to each other by an intermediate sleeve of larger diameter than the upstream section and the downstream section, the upstream section having its respective ends engaged in the radial passage in the sprayer body and in a first end of the sleeve, the downstream section being engaged in the second end of the sleeve, and the sleeve a lateral bore in which the upstream end of the second outlet tube is engaged.

According to another aspect of the invention, an outlet tube receives at its downstream end an outlet end-piece including two outlet orifices, the end-piece having an axial inlet hole force fitted over the downstream end of the outlet tube and communicating with two diverging outlet holes adapted to be oriented toward the respective cooling areas of the piston.

In another aspect, the invention provides an internal combustion engine including at least one nozzle with two outlet tubes as defined hereinabove, the nozzle being conformed and positioned to create and direct at least two jets of cooling fluid toward two respective tunnel inlets hollowed into the mass of a piston.

In an engine of the above kind, at least one of the outlet tubes of the cooling nozzle can advantageously be curved to circumvent a portion of the circumference of the piston, thereby enabling each of the jets to spray the area concerned under the piston without being intercepted by the trajectory of the connecting rod. The two outlet tubes can advantageously direct the jets of cooling fluid toward two piston areas situated on opposite sides of its median plane. This distributes the cooling fluid even more evenly over the piston head surface, for improved cooling.

BRIEF DESCRIPTION OF THE DRAWINGS

Other objects, features and advantages of the present invention will emerge from the following description of particular embodiments of the invention, which is given with reference to the appended drawings, in which:

FIG. 15 is a side view of a nozzle as shown in FIGS. 4 to 7 fitted facing a piston; and FIG. 16 is a side view in section of the nozzle shown in FIGS. 1 to 3.

DESCRIPTION OF THE PREFERRED EMBODIMENTS

Figure 1:
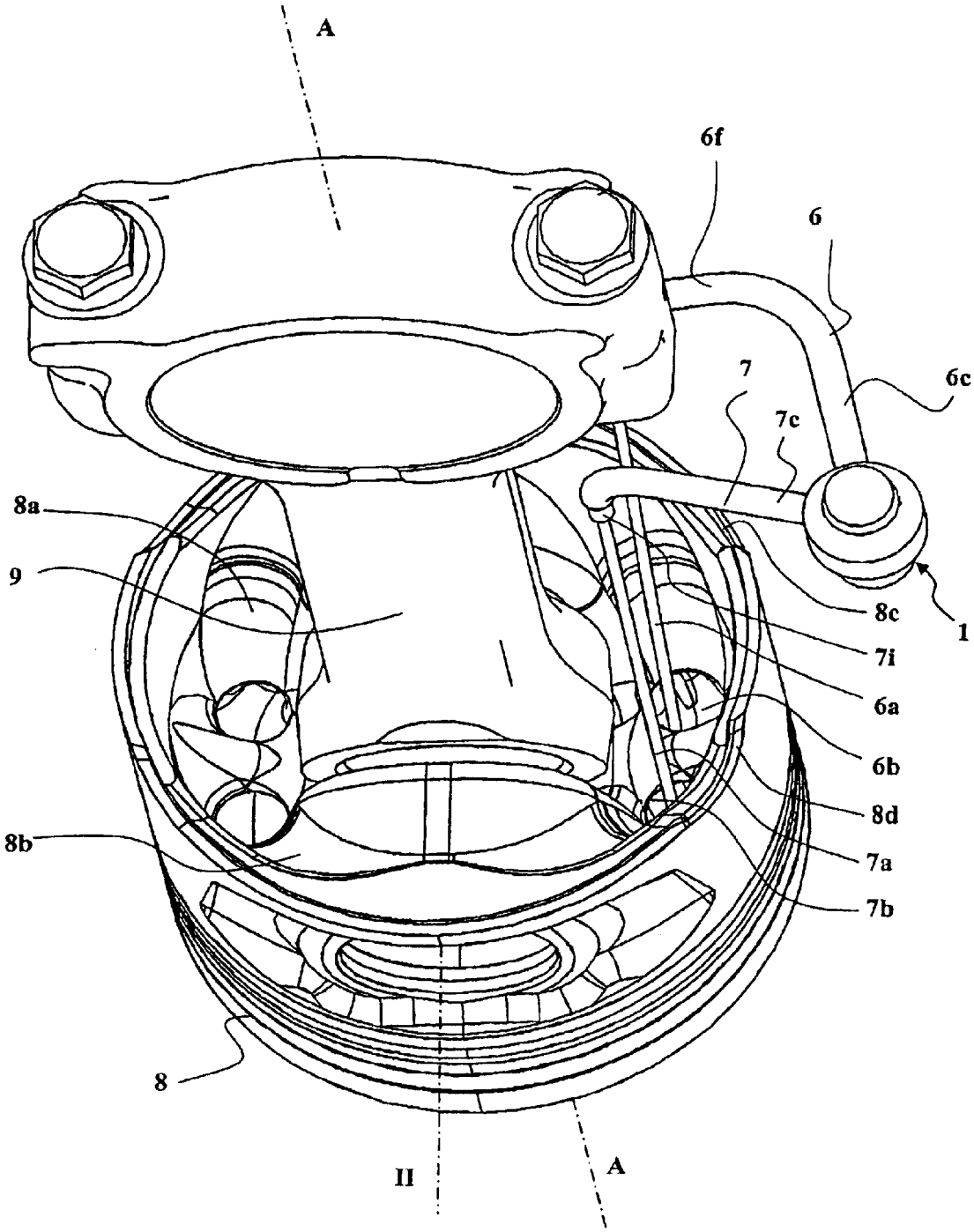
FIG. 1 is a perspective view showing diagrammatically a piston structure and an associated nozzle according to the invention.

In the embodiments shown in the figures, a cooling nozzle 1 in accordance with the invention adapted to cool an internal combustion engine piston 8 includes a nozzle body 2 having a penetrating portion 3 that is conformed to engage axially in an axial penetration direction I—I in a bore in the engine to receive a cooling fluid arriving via said bore, as shown by the arrow 4. The cooling nozzle 1 further includes a projecting outlet structure 5 that communicates with the penetrating portion 3 and includes an axial fluid passage leading from the penetration portion 3 and at least one radial fluid passage 5*a* (and where applicable 5*b*) in the nozzle body 2.

In the embodiments shown in FIGS. 1 to 8, the cooling nozzle 1 includes at least two outlet tubes 6 and 7. The outlet tubes 6 and 7 are each appropriately curved to position and orient the respective outlet orifices 16 and 17 to create respective separate jets 6*a* and 7*a* of cooling fluid, which can be seen in FIGS. 1, 2 and 8, and to direct the two jets 6*a* and 7*a* toward respective separate cooling areas 6*b* and 7*b* of the engine piston 8. Each outlet tube 6 and 7 is a separate component that is fabricated by cutting into lengths and forming from a drawn metal tube and attached by force fitting and brazing. This avoids having to cast and machine complex one-piece components. Also, this has the advantage that drawn metal tubes have a very smooth and regular inside surface, encouraging laminar fluid flow.

Figure 3:
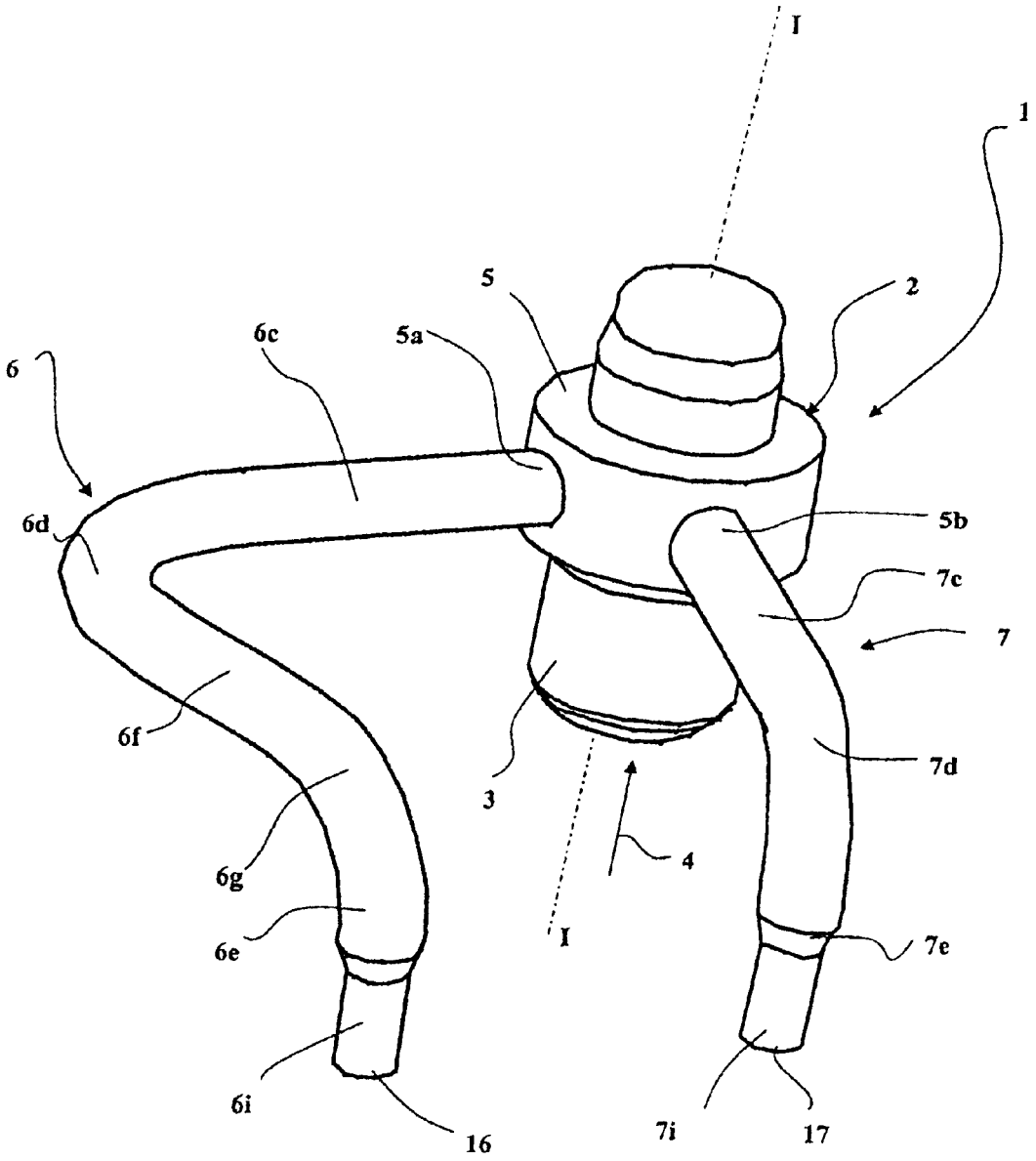
FIG. 3 is a perspective view of an advantageous embodiment of a nozzle according to the invention.
Figure 4:
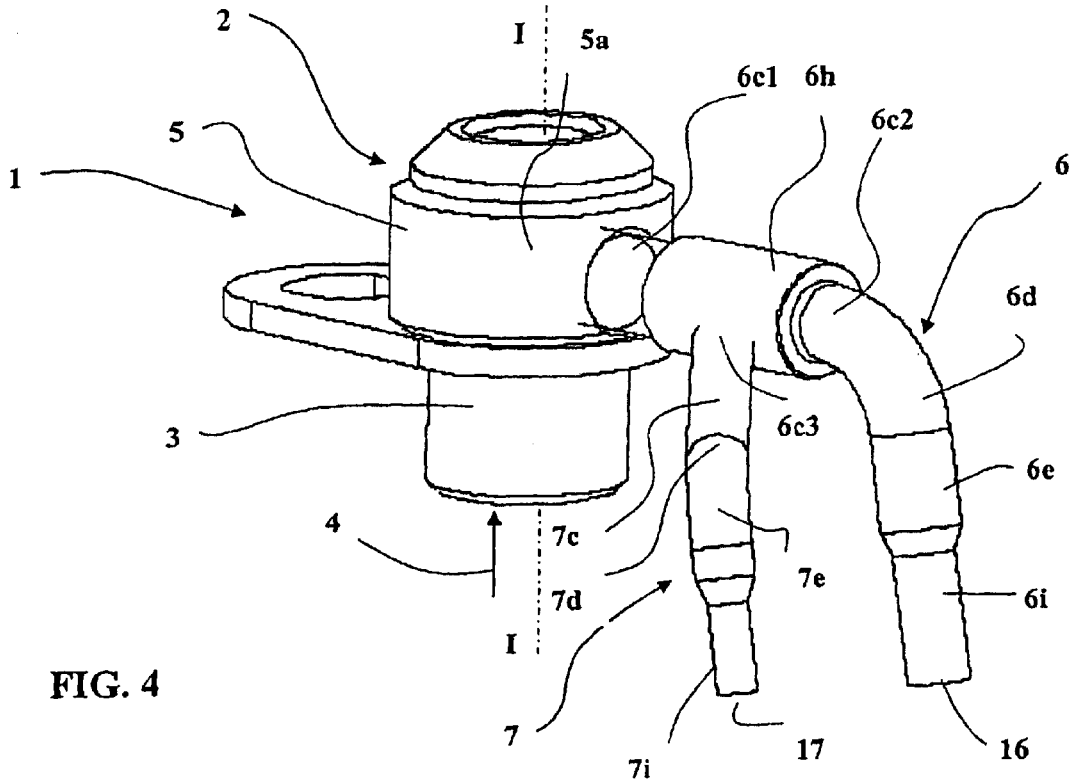
FIG. 4 is a perspective view of another embodiment of a nozzle according to the invention.

In both of the embodiments shown in FIGS. 3 and 4, the first outlet tube 6 includes a first connecting radial section 6*c* which is generally perpendicular to the axial direction I—I in which the nozzle penetrates into the engine block and is connected via an elbow 6*d* to a first axial spraying section 6*e* having a first orifice 16 that projects the jet 6*a* of cooling fluid in a generally axial direction relative to the piston 8. The second outlet tube 7 includes a second radial connecting section 7*c* that is substantially perpendicular to or at a large angle to the first radial connecting section 6*c* and is connected via an elbow 7*d* to a second axial spraying section 7*e* which has a second orifice 17 which therefore sprays a jet 7*a* of cooling fluid in a generally axial direction, i.e. in a direction parallel to the axis along which the piston 8 moves in the engine cylinder, the two jets 6*a*, 7*a* of cooling fluid being a relatively large distance from each other.

Figure 2:
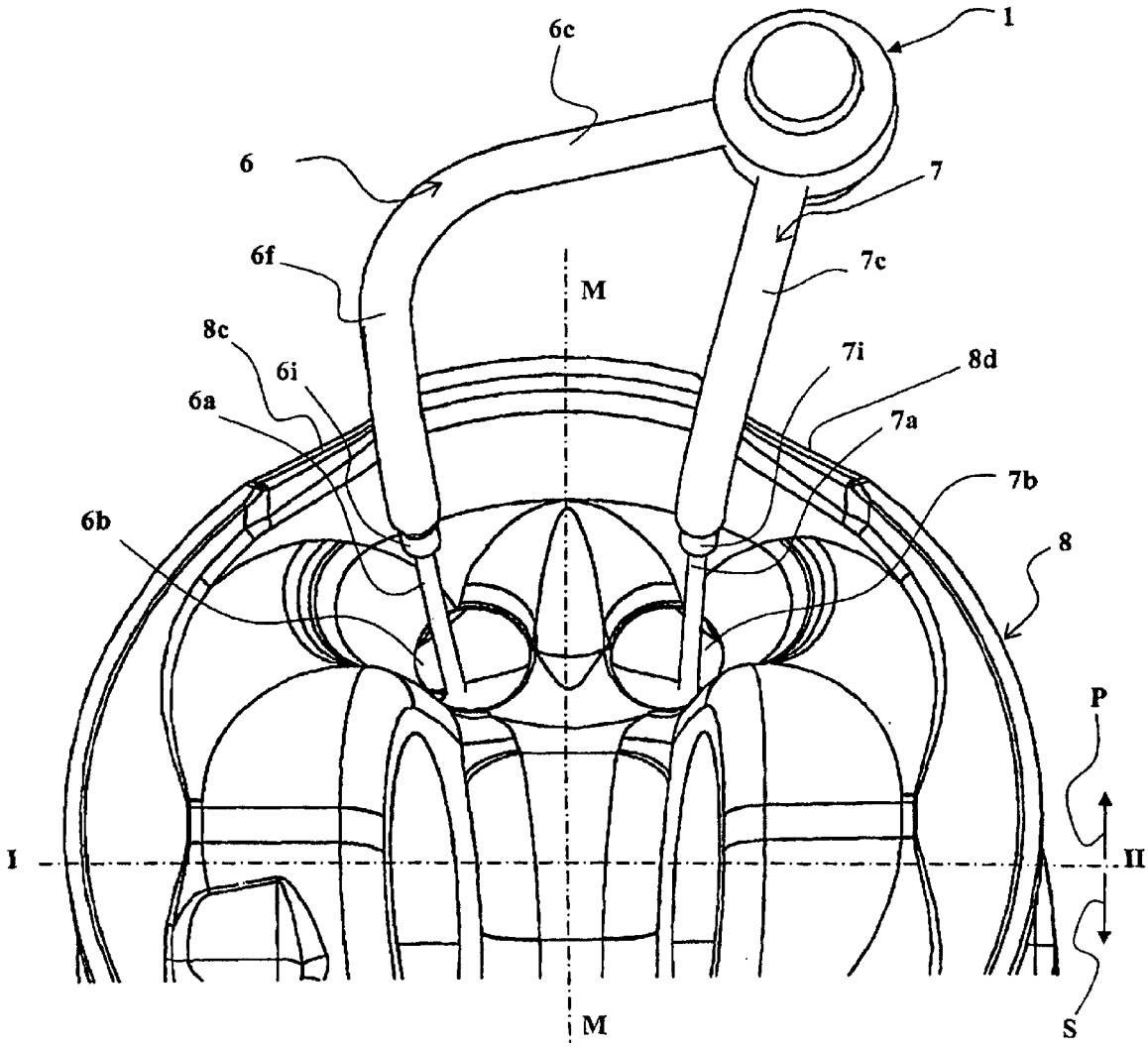
FIG. 2 is another perspective view of the piston associated with the nozzle shown in FIG. 1.

In the embodiment shown in FIGS. 1 to 3, two outlet tubes 6 and 7 are connected to the nozzle body via respective separate radial passages 5*a* and 5*b* of the outlet structure 5 and two radial connecting sections 6*c* and 7*c*. The radial connecting sections 6*c* and 7*c* are substantially perpendicular to each other and both are perpendicular to the axial penetration direction I—I. Furthermore, the first outlet tube 6 includes a connecting section 6*f* extending in a direction that is generally parallel to or convergent with respect to the second radial connecting section 7*c* of the second outlet tube 7 and is connected at an angle to the first radial connecting section 6*c* via an elbow 6*d* and to a first axial spraying section 6*e* via a second elbow 6*g*, as shown clearly in FIG. 3. This form of nozzle is adapted to spray two jets of cooling fluid toward two areas of the same piston situated on opposite sides of the median plane of the piston.

Thus FIGS. 1 and 2 show this first embodiment of the cooling nozzle 1 in position in an engine facing a piston 8 driven by a connecting rod 9 oscillating in the median plane M—M of the piston 8 about an oscillation axis II—II. The median plane M—M contains the axis A—A of movement in translation of the piston 8 and is perpendicular to the oscillation axis II—II of the connecting rod 9. The second radial connecting section 7*c* penetrates radially under the piston 8 in the direction of its axis A—A. The first radial connecting section 6*c* circumvents a portion of the circumference of the piston 8, after which the connecting section 6*f* penetrates radially under the piston 8 in the direction of its axis A—A. If necessary, the skirt of the piston comprises notches 8*c* and 8*d* for the sections 7*c* and 6*f*, respectively.

The two jets 6*a* and 7*a* of cooling fluid produced by the cooling nozzle 1 are directed toward respective cooling areas 6*b* and 7*b* on opposite sides of the median plane M—M of the piston 8. In this case, the two cooling areas 6*b* and 7*b* are two inlet orifices of one or two tunnels provided in the mass of the piston 8, and the cooling fluid therefore penetrates into the piston tunnel(s) to propagate as close as possible to thrust surface at the top 8*e* (FIG. 15) of the piston, on which surface the calorific energy of the combustion gases impinges.

Because of the overall size of the cooling oil feed passages, the cooling nozzles in an engine are usually disposed in a first half-space P containing the engine inlet system. However, the highest temperature portions of the engine, and thus of the piston 8, are in a second half-space S containing the exhaust system of the engine. Providing a cooling nozzle 1 that produces two jets 6*a* and 7*a* of cooling fluid on opposite sides of the median plane M—M means that it is possible to feed two tunnel inlets that communicate, via a tunnel in the form of a circular ring, or via two respective tunnels in the shape of a sector of a ring subtending an angle less than 180°, with respective piston areas 8*a* and 8*b* in the half-space S. This balances the cooling of the highest temperature areas 8*a* and 8*b*.

Figure 5:
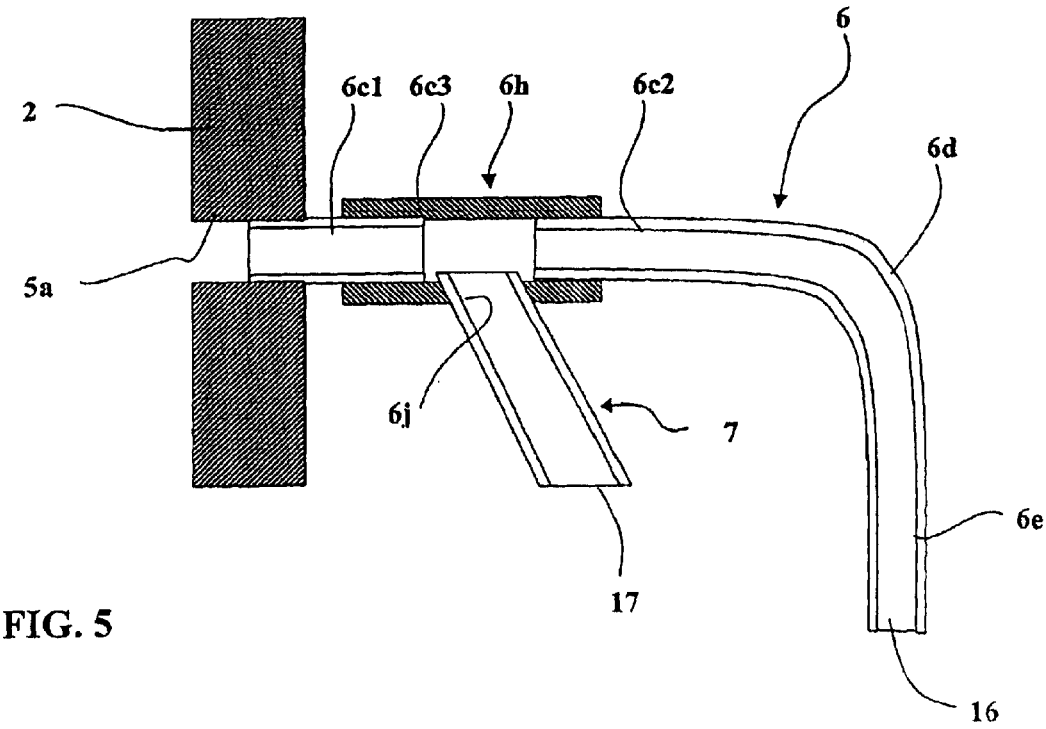
FIG. 5 is a partial view in longitudinal section of a first variant of an outlet structure of the nozzle shown in FIG. 4.

In a second embodiment shown in FIGS. 4 and 5, the outlet structure comprises a first outlet tube 6 which is connected to the nozzle body via a single radial passage 5*a*. The first outlet tube 6 includes the first orifice 16 and has a larger diameter intermediate section 6*h* to which is connected the second outlet tube 7, which includes the second orifice 17.

In the embodiment more specifically shown in FIG. 5, the first outlet tube 6 has an upstream section 6*c*1, a downstream section 6*c*2, an elbow 6*d*, an axial spraying section 6*e*, and an intermediate sleeve 6*c*3 forming an intermediate section 6*h* of larger diameter than the upstream section 6*c*1 and the downstream section 6*c*2. Respective ends of the upstream section 6*c*1 are engaged in the radial passage 5*a* in the nozzle body and in a first end of the sleeve 6*c*3. The downstream section 6*c*2 is engaged in the second end of the sleeve 6*c*3. The sleeve 6*c*3 has a lateral bore 6*j* in which the upstream end of the second outlet tube 7 is engaged.

Figure 6:
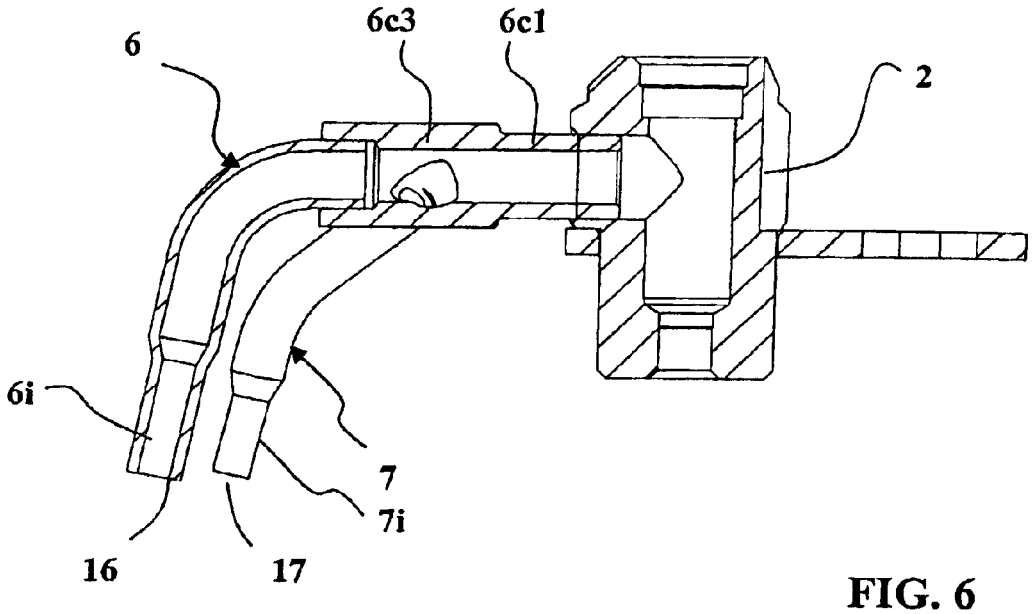
FIGS. 6 and 7 are respectively a partial longitudinal sectional view and a top view of a second variant of the outlet structure of the nozzle shown in FIG. 4.
Figure 7:
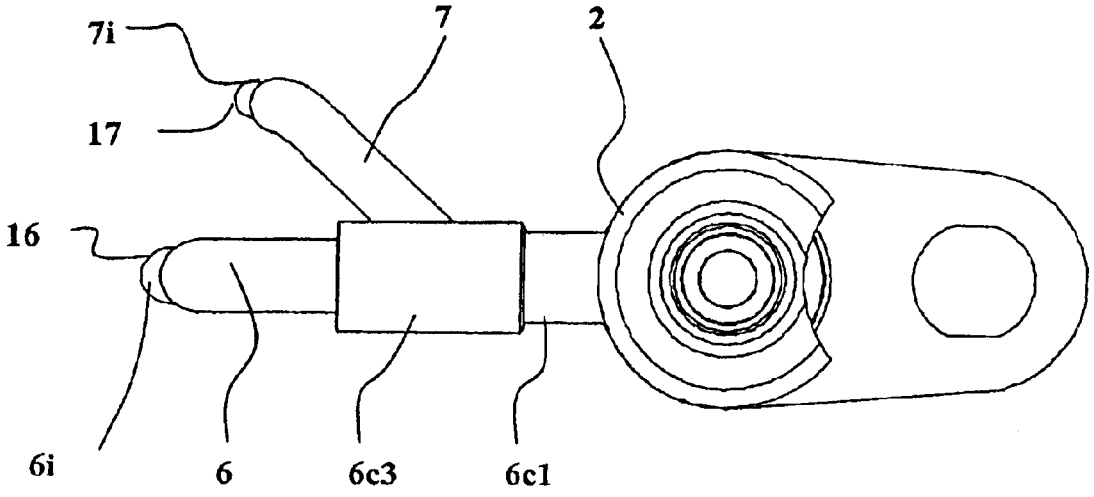

In a variant shown in FIGS. 6 and 7, the upstream section 6*c*1 and the sleeve 6*c*3 are in one piece.

In both cases, the distance between the two jets 6*a* and 7*a* of cooling fluid is large, but the offsetting of the tubes toward the outside is insufficient to place the orifices 16 and 17 on opposite sides of the median plane M—M. The cooling nozzle 1 is therefore placed with its two outlet tubes 6 and 7 on the same side of the median plane M—M.

Nozzles in accordance with the invention can be designed to have more than two outlet tubes and thus to generate more than two jets of cooling fluid.

Figure 8:
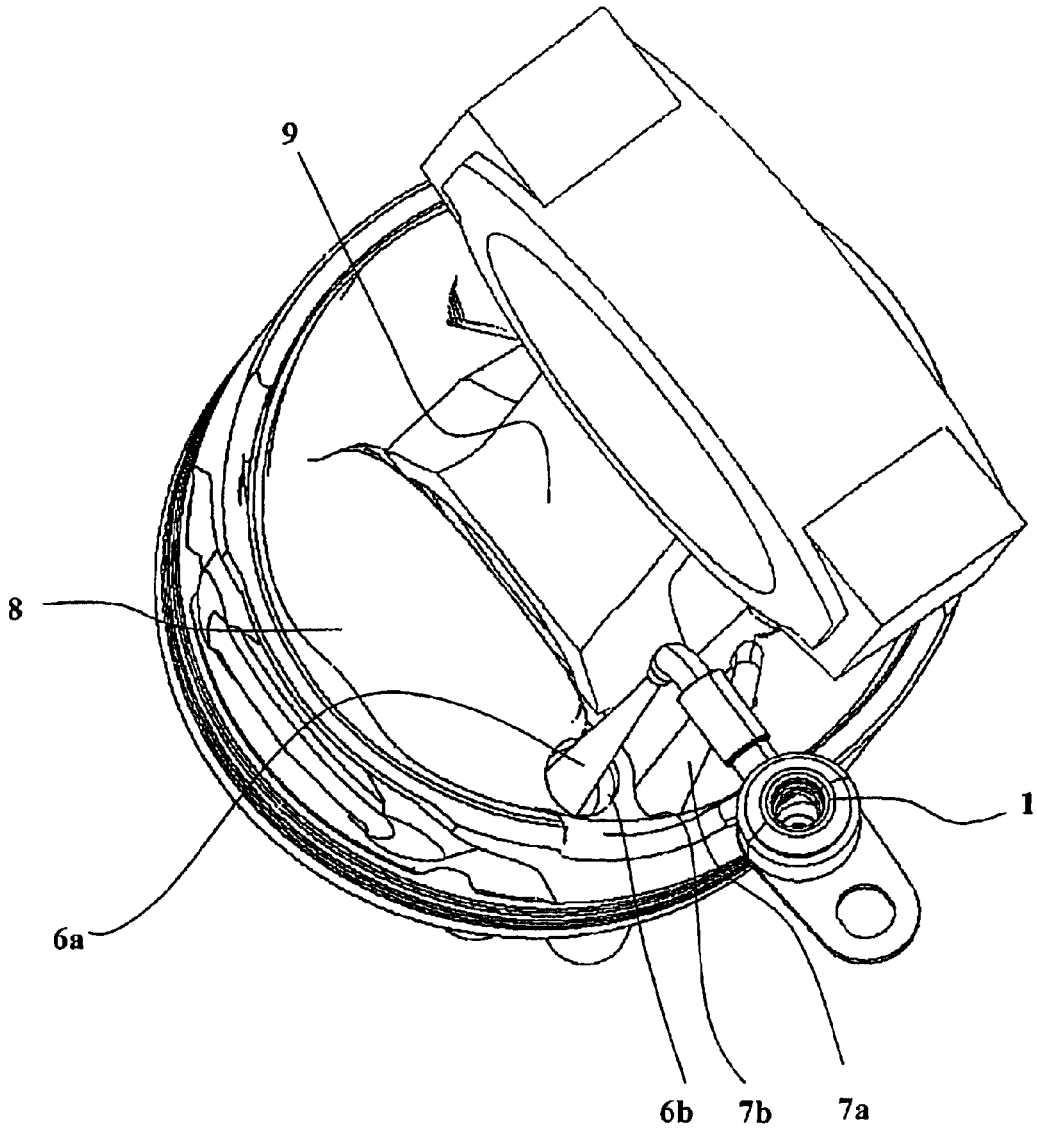
FIG. 8 shows an engine with a nozzle producing a first jet that is sprayed toward a piston tunnel and a second jet that is sprayed toward an area to be lubricated.

In the embodiments shown in FIGS. 1 to 4 and in FIGS. 6 to 8, at least one of the outlet tubes 6 and 7 includes a constriction forming a smaller diameter end section 6*i*, 7*i*, the technical effect of which is:

to guarantee high accuracy of the inside diameter of the tube, and therefore to guarantee good accuracy of the cooling fluid flowrate, to improve the quality of the jet, by producing a laminar and concentrated jet, to increase the speed and the accuracy of the jet at the tube outlet, to facilitate defining identical or different flowrates of the outlet tubes 6 and 7, as a function of different piston areas with a higher or lower priority for cooling.

To maximize the percentage of the total flowrate of the cooling fluid through the nozzle that penetrates into the tunnel(s) of the piston 8, the nozzle tubes can advantageously be conformed so that the jets of cooling fluid are parallel to the axis A—A of the piston 8.

However, in some engine configurations, the nozzle must be offset radially away from the axis A—A of the piston 8. It may then be advantageous to incline the cooling jets 6*a* and 7*a* in a radial plane at a slightly re-entrant angle of a few degrees relative to the axis A—A of the piston 8.

FIGS. 9 to 14 show a cooling nozzle including an outlet tube receiving an outlet end-piece for dividing the jet of cooling fluid into two jets 6*a* and 7*a*.

This embodiment also includes a nozzle 1 having a nozzle body 2 with a penetrating portion 3 and an outlet structure 5 with a radial passage 5*a*.

There is also a curved outlet tube 6 whose first end is force fitted into the radial hole 5*a* and whose second end is force fitted into an outlet end-piece 10.

Figure 10:
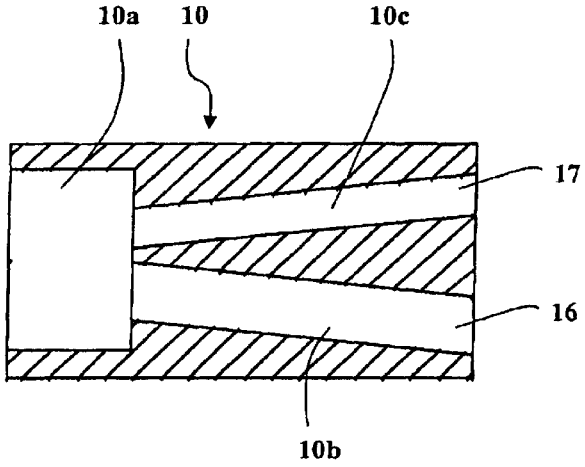
FIG. 10 is a front view in longitudinal section of a nozzle end-piece shown in FIG. 9.

As shown in FIG. 10, the outlet end-piece 10 has an axial inlet hole $\mathbf{10}_a$ conformed to be force fitted over the downstream end of the outlet tube 6 and communicating with two divergent outlet holes 10*c* and 10*c* adapted to be oriented toward respective cooling areas of the piston. Thus the two outlet holes 10*b* and 10*c* define respective outlet orifices 16 and 17 of the cooling nozzle.

The axial inlet hole 10*b* can advantageously have a circular cylindrical shape adapted to receive the cylindrical downstream end of the outlet tube 6.

The two outlet holes 10*b* and 10*c* can have different diameters; for example, the outlet hole 16 can have a diameter greater than the diameter of the outlet hole 17. The diameters are chosen to improve the distribution of the outflows from the orifices by increasing the flowrate for spraying areas with higher priority for cooling and reducing the flowrate for spraying areas with lower priority for cooling. The orientation angles of the outlet holes 10*b* and 10*c* are chosen to correspond to the locations of the respective cooling areas of the piston. The outlet holes 10*b* and 10*c* are closer together at their upstream end in order to communicate directly with the interior of the outlet tube 6.

Figure 9:
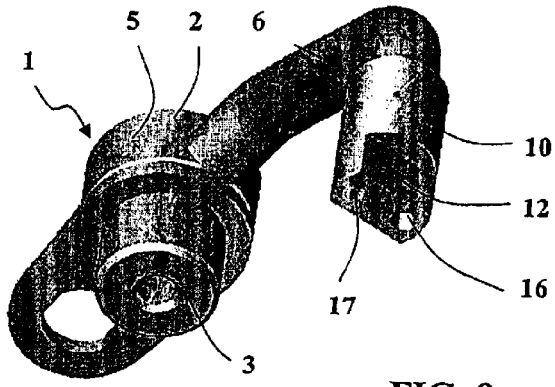
FIG. 9 is a perspective view of another embodiment of a nozzle according to the invention.
Figure 11:
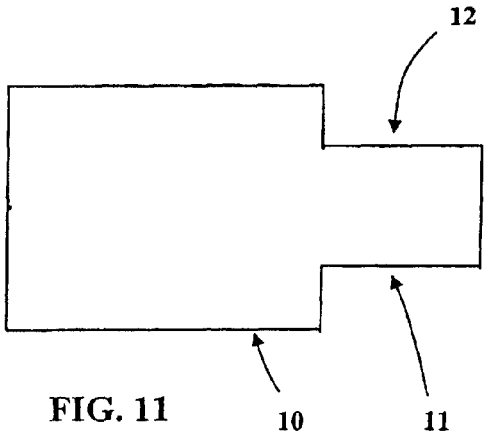
FIGS. 11 and 12 show the FIG. 9 nozzle end-piece from above and from the left-hand side.
Figure 12:
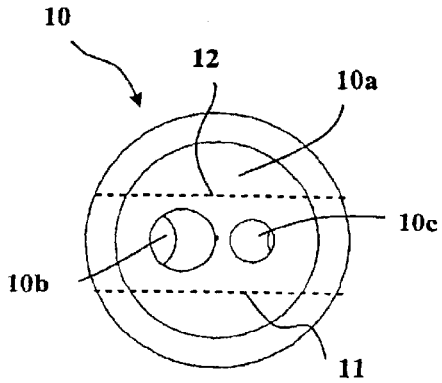
Figure 13:
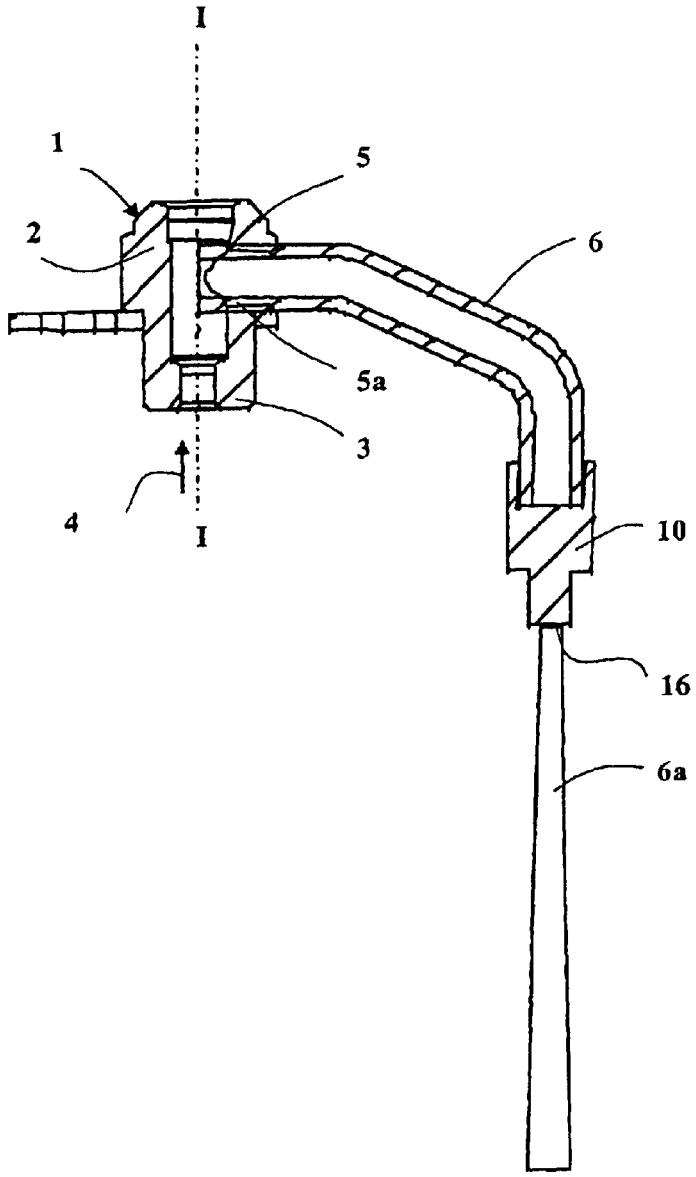
FIGS. 13 and 14 are side and front views in longitudinal section of the FIG. 9 nozzle.

As shown in FIGS. 9, 11 and 12, the outlet end-piece 10 has on its external peripheral face at least one flat 11 or 12 for identifying and fixing the angular position of the outlet end-piece 10 around the outlet tube 6, allowing rotational orientation of the two outlet holes 16 and 17 when mounting the end-piece 10 on the outlet tube 6.

The outlet end-piece 10 can be used independently of the other number and shape features of the outlet tubes 6 and 7.

Figure 14:
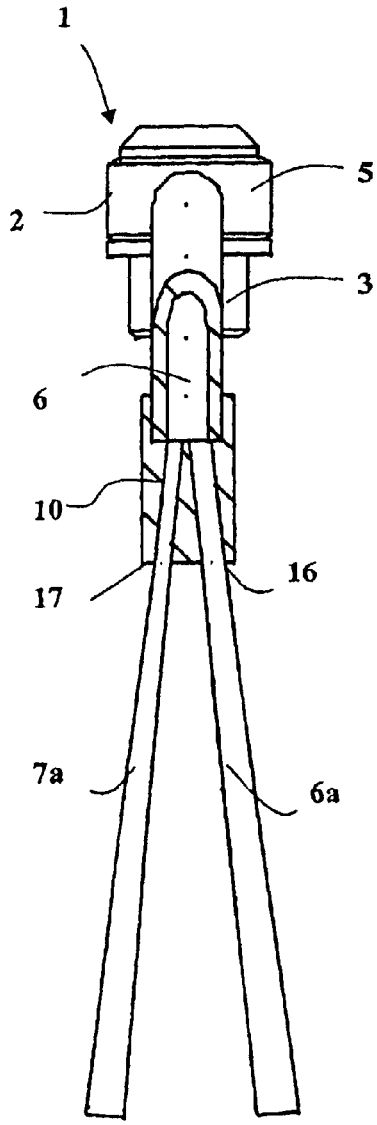

In all the embodiments described hereinabove, the proximal ends of the outlet tubes 6 and 7 are force fitted and brazed. Thus FIG. 16 shows in section the force fitting of the outlet tube 7 into the radial passage 5*b* in the nozzle body 2 of the nozzle shown in FIG. 3. FIG. 5 shows in section the force fitting of the two tubes 6 and 7. FIG. 14 further shows the force fitting of the outlet tube 6 into the nozzle body 2.

Thus the invention provides an internal combustion engine comprising at least one cooling nozzle 1 with two outlet tubes 6 and 7 as previously defined, the cooling nozzle 1 being conformed and positioned to create and direct at least two jets of cooling fluid 6*a* and 7*a* toward respective tunnel inlets 6*b* and 7*b* hollowed into the mass of a piston 8, as shown in FIGS. 1 and 2.

In an engine of the above kind, the outlet tubes 6 and 7 can be curved to circumvent a portion of the circumference of the piston 8 and to lie outside the trajectory of the piston 8 and the connecting rod 9 during operation, thus directing the jets 6*a* and 7*a* of cooling fluid axially toward two piston areas 6*b* and 7*b* situated on opposite sides of its median plane M—M. FIG. 2 shows that the second outlet tube 7 extends radially toward the center of the piston and that the first outlet tube 6 extends, firstly, along the periphery of the piston (section 6*c*) and then radially toward the center of the piston (section 6*f*).

Alternatively, a nozzle as shown in FIGS. 4 to 7 can spray two jets of cooling fluid toward two areas 6*b* and 7*b* on the same side of the median plane M—M or toward two areas 6*b* and 7*b* on opposite sides of the plane M—M. In the latter case the effectiveness of cooling is reduced because the connecting rod 9 momentarily intersects the jet 7*a* during a portion of its cycle of movement.

The present invention is not limited to the embodiments that have been described explicitly and encompasses variants and generalizations thereof within the scope of the following claims.

What is claimed is:

1. A cooling nozzle for cooling a piston of an internal combustion engine, the nozzle including a nozzle body having a penetrating portion conformed to be engaged axially in a bore in the engine in an axial penetration direction and to receive a cooling fluid arriving via said bore and an outlet structure having at least one radial fluid passage in the nozzle body and at least one first outlet passage and one second outlet passage adapted to direct toward the piston to be cooled at least two separate jets of cooling fluid, wherein the first outlet passage comprises a first outlet tube attached to the nozzle body and including a first radial connecting section generally perpendicular to the axial penetration direction and connected by an elbow to a first axial spraying section terminating at a first orifice and the second outlet passage comprises a second outlet tube including a second radial connecting section offset angularly away from the first radial connecting section and connected by an elbow to a second axial spraying section terminating at a second orifice.

2. A cooling nozzle according to claim 1, wherein the outlet tubes are connected to the nozzle body by separate radial passages in which proximal ends of the outlet tubes are force fitted and brazed.

3. A cooling nozzle according to claim 2, wherein two outlet tubes are connected to the nozzle body by two separate radial passages and by two radial connecting sections substantially perpendicular to each other and perpendicular to the axial penetration direction, the first outlet tube having a connecting section that extends in a direction generally parallel to or convergent with respect to the radial connecting section of the second outlet tube and is angularly connected, firstly, to the first radial connecting section by an elbow and, secondly, to a first axial spraying section by a second elbow, so as to spray cooling fluid toward two areas of the same piston at a relatively great distance from each other and away from all components moving in the engine cylinder.

4. A cooling nozzle according to claim 1, wherein a first outlet tube is connected to the sprayer body by a single radial passage, the first outlet tube including the first orifice and having a larger diameter intermediate section to which a second outlet tube including the second orifice is connected.

5. A cooling nozzle according to claim 4, wherein the first outlet tube has an upstream section, a downstream section, and an intermediate sleeve of larger diameter than the upstream section and the downstream section, the upstream section having its respective ends engaged in the radial passage in the sprayer body and in a first end of the sleeve, the downstream section being engaged in the second end of the sleeve, and the sleeve including a lateral bore in which the upstream end of the second outlet tube is engaged.

6. A cooling nozzle according to claim 1, wherein at least one of the outlet tubes includes a constriction forming a smaller diameter end section.

7. A cooling nozzle according to claim 1, wherein an outlet tube is connected to an outlet end-piece including the two outlet orifices, the end-piece having an axial inlet hole force fitted over the downstream end of the outlet tube and communicating with two diverging outlet holes adapted to be oriented toward the respective cooling areas of the piston.

8. A cooling nozzle according to claim 7, wherein the outlet end-piece has on its external peripheral surface at least one flat for identifying and fixing the angular position of the outlet end-piece around the outlet tube.

9. An internal combustion engine including at least one nozzle according to claim 1 with two outlet tubes conformed and positioned to create and direct at least two jets of cooling fluid toward two respective tunnel inlets hollowed into the mass of a piston.

10. An engine according to claim 9, wherein one of the outlet tubes is curved to circumvent a portion of the circumference of the piston, thereby enabling each of the jets to spray the area concerned under the piston without being intercepted by the trajectory of the connecting rod, and the outlet tubes direct the jets of cooling fluid toward two piston areas situated on opposite sides of its median plane.

11. An engine according to claim 9, wherein the jets of cooling fluid are parallel to the axis of the piston.

12. An engine according to claim 9, wherein the jets of cooling fluid are inclined in a radial plane at a slightly re-entrant angle of a few degrees with respect to the axis of the piston.

13. An engine according to claim 9, wherein the two tunnel inlets each communicate with a respective tunnel in the shape of a sector of a ring subtending an angle of less than 180°.

14. An engine according to claim 9, wherein the two tunnel inlets communicate with the same ring-shaped tunnel.

* * * * *